US007599635B2

(12) United States Patent
Nakaso

(10) Patent No.: US 7,599,635 B2
(45) Date of Patent: Oct. 6, 2009

(54) IMAGE FORMING APPARATUS AND IMAGE FORMING SYSTEM

(75) Inventor: Koji Nakaso, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 11/016,801

(22) Filed: Dec. 21, 2004

(65) Prior Publication Data

US 2005/0141911 A1 Jun. 30, 2005

(30) Foreign Application Priority Data

Dec. 22, 2003 (JP) ..... 2003-424613

(51) Int. Cl.
*G03G 15/16* (2006.01)
*G03G 15/00* (2006.01)

(52) U.S. Cl. ..... 399/66; 399/82; 399/45

(58) Field of Classification Search ..... 399/82, 399/45, 66

See application file for complete search history.

(56) References Cited

U.S. PATENT DOCUMENTS 6,429,886 B2 * 8/2002 Ohki ..... 347/115
6,636,708 B2 * 10/2003 Takahashi ..... 399/66
6,701,099 B2 * 3/2004 Yokobori et al. ..... 399/45
2001/0055495 A1 * 12/2001 Dreher et al. ..... 399/45

FOREIGN PATENT DOCUMENTS

JP 11-305565 11/1999
JP 2001-083751 3/2001

* cited by examiner

*Primary Examiner*—Vincent Q Nguyen
*Assistant Examiner*—Jeff Natalini
(74) *Attorney, Agent, or Firm*—Rabin & Berdo, PC

(57) ABSTRACT

What is disclosed is an image forming apparatus which receives a job of a printing from outside of the apparatus with an instruction of changing a condition of transfer that corresponds to said job and that is valid only for said job. And, the image forming apparatus comprising: a transferring unit for transferring an image formed with a toner based on said job, a memory section for memorizing, and a setting section for setting a condition of transfer.

9 Claims, 13 Drawing Sheets

IMAGE FORMING APPARATUS AND IMAGE FORMING SYSTEM

BACKGROUND OF THE INVENTION

1. Field of the Invention

The present invention relates to an image forming apparatus which corrects a condition of transfer and an image forming system which includes this image forming apparatus.

2. Description of Related Art

In a process of printing performed by an ordinary image forming apparatus such as an apparatus with an electrophotographic method, first of all, a surface of a holder of an image is uniformly charged. On this surface of a holder of an image, a prescribed electrostatic latent image is formed by exposing the surface to a light. The electrostatic latent image is developed by a toner. Then, an image is formed with toner on the surface of a holder of the image. This image of toner is transferred, based on a control of levelling voltage or levelling current, on a recording medium by a transferring unit. A feature of the transfer is much influenced by a change of temperature or humidity of circumstances. To decrease this influence to be as low as possible, a method for controlling transfer is disclosed. This method is a method for transferring with a condition. This condition is set based on a resistance of the transferring unit. This resistance is calculated from a current detected and a voltage generated, when a prescribed current is flown in the transferring unit (c.f. JP2001-83751). Moreover, another method for controlling transfer is disclosed. This method is a method for transferring with a condition. This condition is set based on data obtained from a thermal sensor (c.f. JP11-305565).

Even in case that the two methods mentioned above are used, all the users cannot always obtain the best result of printing which they want.

In case that either of the two methods mentioned above are used, each user can obtain near to the best result of printing which he or she wants. However, following inconvenience occurs. It occurs when an image forming apparatus is connected to a network and the image forming apparatus is commonly used by many users. When one of the many users changed the condition of transfer according to his own choice, other users do not like the changed condition. Then, another user obtains a result of printing which he does not want.

That is, there is a problem to solve, that either of the other users obtain a result of printing which he does not want, when an image forming apparatus is connected to a network and the image forming apparatus is commonly used by many users, in case that one of the many users changed the condition of transfer according to his own choice and other users do not like the changed condition.

SUMMARY OF THE INVENTION

According to one aspect of the present invention, there is provided an image forming apparatus which receives a job of a printing from outside of the apparatus with an instruction of changing a condition of transfer that corresponds to said job and that is valid only for said job.

According to another aspect of the present invention, there is provided an image forming system where an image forming apparatus connected to the system receives a job of a printing from other apparatus connected to the system with an instruction of changing a condition of transfer that corresponds to said job and that is valid only for said job.

DESCRIPTION OF THE PREFERRED EMBODIMENTS

Embodiment 1

<Configuration>

Figure 1:
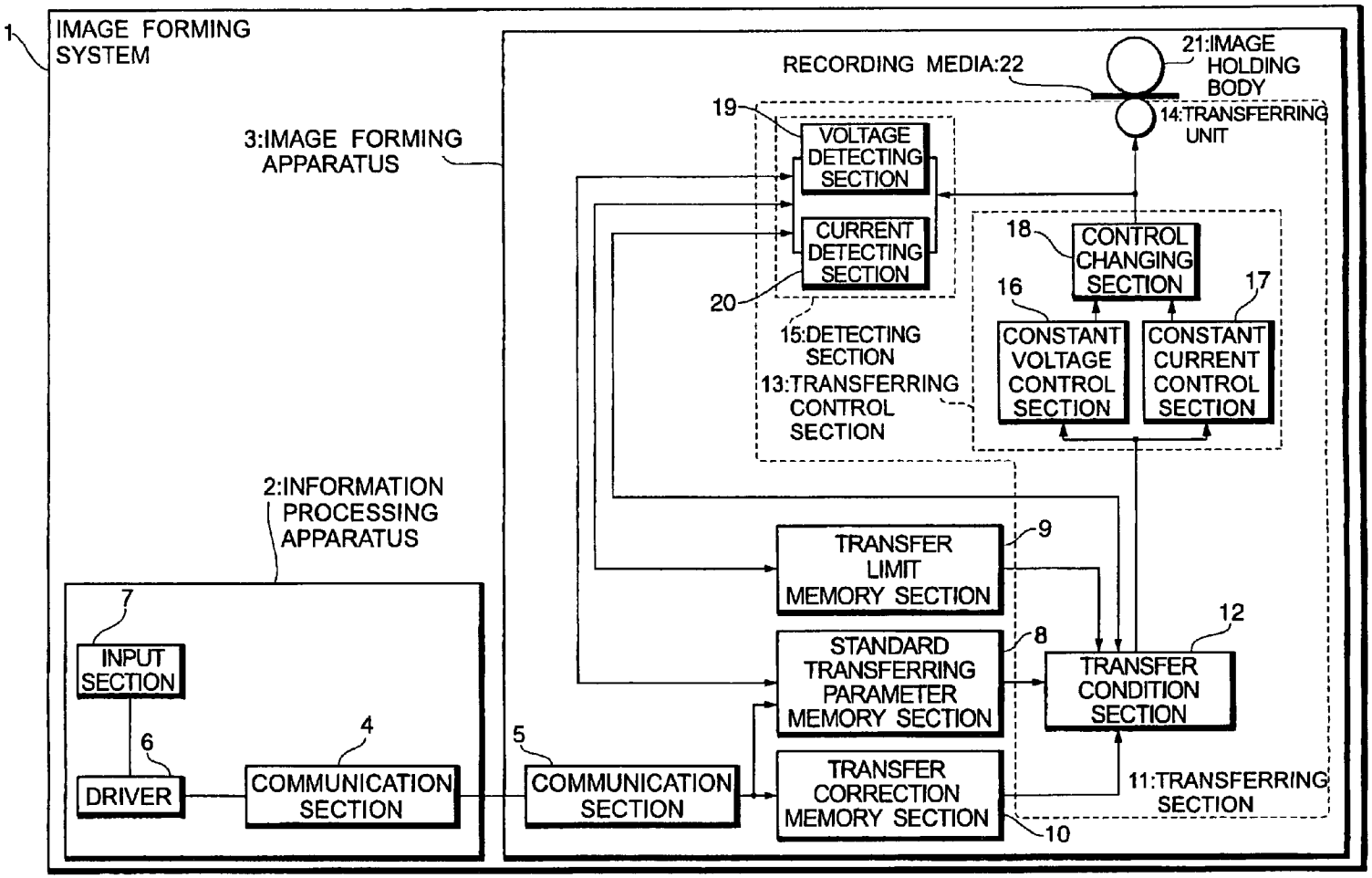
FIG. 1 is a block diagram showing an image forming system of the present invention.

FIG. 1 is a block diagram showing an image forming system of the present invention.

As shown in FIG. 1, an image forming system 1 of Embodiment 1 comprising an information processing apparatus 2 and an image forming apparatus 3. Here, the information processing apparatus 2 and the image forming apparatus 3 are connected with a serial interface or network not shown in the drawing.

Before describing each structure of each apparatus in detail, a general structure of a mechanism of the image forming apparatus 3 will be described. As an example, chief component parts and an operation of an electrophotographic processing section will be described.

Figure 2:
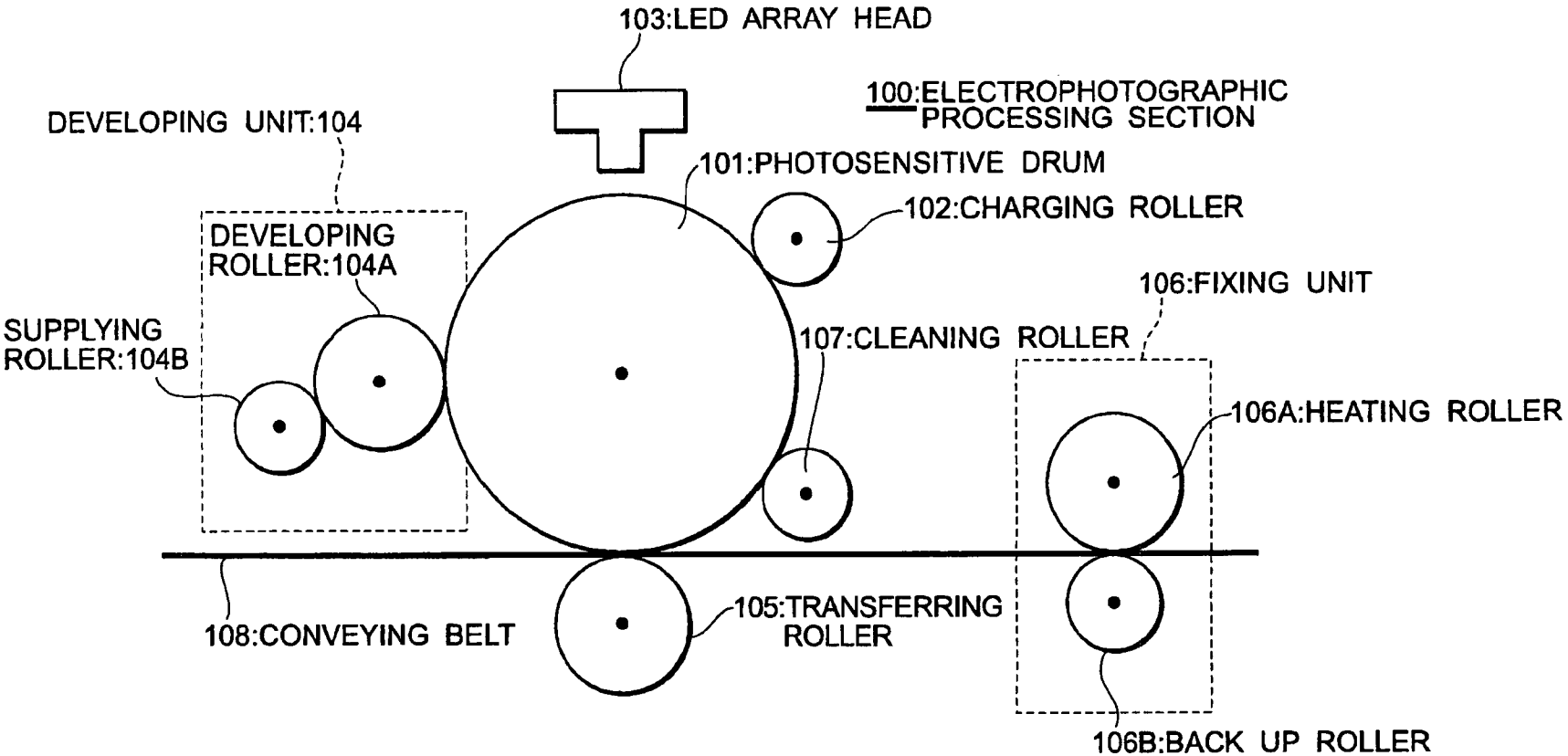
FIG. 2 is a sectional diagram showing a chief portion of electrophotographic process portion.

FIG. 2 is a sectional diagram showing a chief portion of electrophotographic process portion.

As shown in FIG. 2, an electrophotographic processing section 100 comprises a photosensitive drum 101, a charging roller 102, an LED array head 103, a developing unit 104, a transferring roller 105, a fixing unit 106, a cleaning roller 107 and a conveying belt 108.

A surface of the photosensitive drum 101 is uniformly charged by the charging roller 102, when they rotate. When a charged portion of the photosensitive drum 101 reached to the LED array head 103 after the photosensitive drum 101 rotated, a ray of light is radiated by the LED array head 103. And, a latent image of static electricity is formed on the surface of the photosensitive drum 101.

When the latent image of static electricity reached to the developing unit 104 after the photosensitive drum 101 rotated, the latent image of static electricity is developed by a toner supplied to the surface of a developing roller 104A by a supplying roller 104B. This developed image with a toner is transferred onto a recording medium conveyed on the conveying belt 108 moved by a transferring roller 105. The present invention especially concerns to this section.

This transferred image of a toner is fixed on a recording medium with a heat by a heating roller 106A of a fixing unit 106 and with a pressure by a back up roller 106B of the fixing unit 106. On the other hand, a toner remained on the photosensitive drum 101 is cleaned by a cleaning roller 107. That is all of the description of the general structure and operation of electrophotographic processing section. Therefore, returning to FIG. 1, the structure of the image forming system of the present invention will be described. For the convenience of describing the system, the image forming apparatus 3 will be described first. After that, the information processing apparatus 2 of a host device will be described next.

The image forming apparatus 3 comprises a communication section 5, a standard transferring parameter memory section 8, a transfer limit memory section 9, a correct transferring parameter memory section 10, a transferring section 11 and an image holding body 21. The communication section 5 is a section for connecting the image forming apparatus 3 with a serial interface or network not shown in the drawing, which is connected with the information processing apparatus 2.

The standard transferring parameter memory section 8 is a memory section for containing the standard information of transfer for each recording medium, to become a setting table contained beforehand. An example of the standard information of transfer, in case of control of levelling a voltage, is described as follows.

Figure 3:
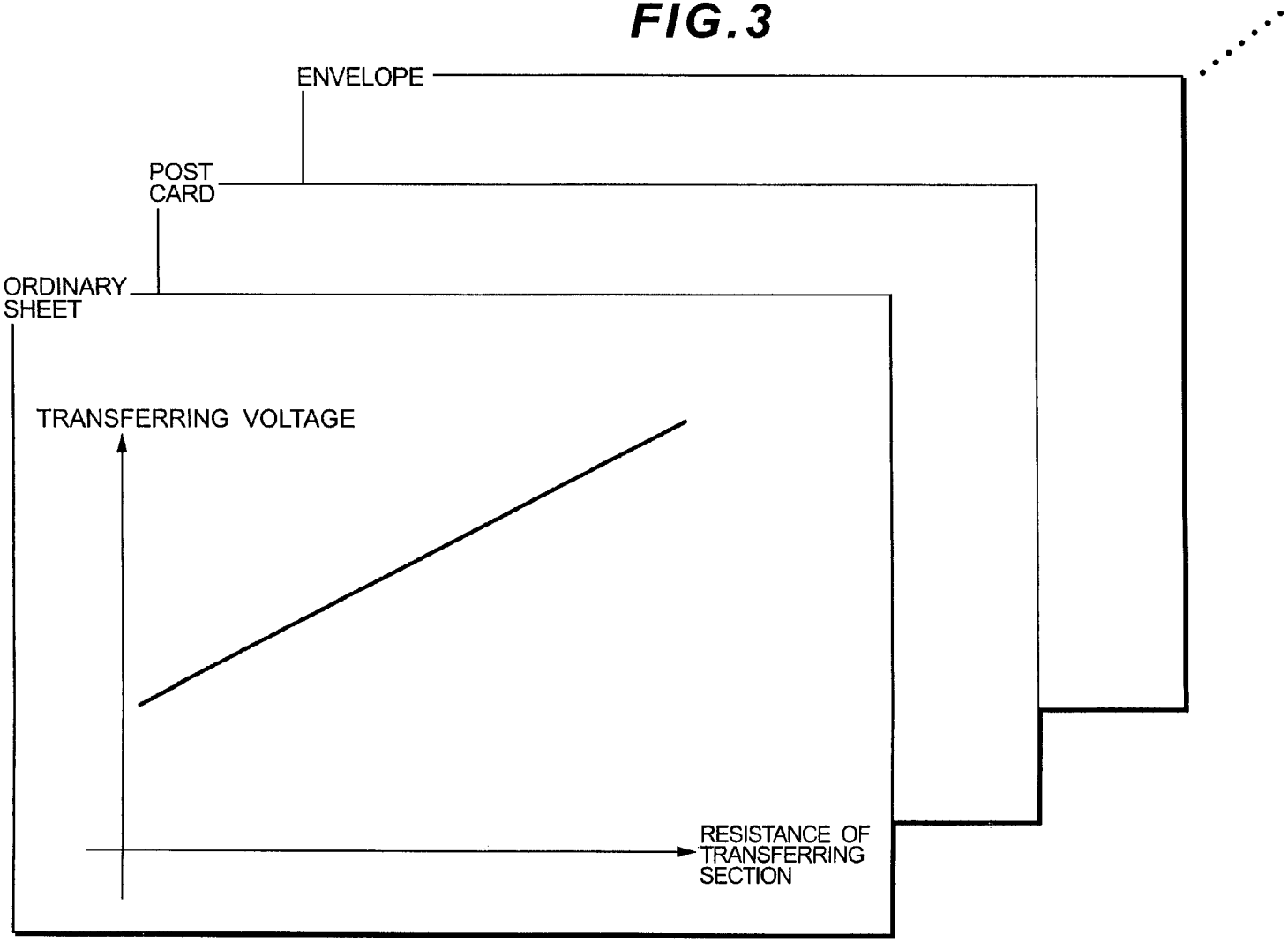
FIG. 3 shows a setting table of standard information of transfer of Embodiment 1.

FIG. 3 shows a setting table of standard information of transfer of Embodiment 1.

As shown in FIG. 3, a setting table of standard information of transfer are contained corresponding to each kind of the recording media such as an ordinary sheet, a post card, an envelope etc. An abscissa of each table represents a value of resistance of the transferring unit. An ordinate of each table represents a voltage of transfer corresponding to each value of resistance of the transferring unit.

The transfer limit memory section 9 contains a range where a correction is allowable, corresponding to each standard information of transfer. Why a range is set is as follows. Lack of transfer such as dim of an image occurs in case that the voltage of transfer is too low. Excess of transfer such as stain of an image occurs in case that the voltage of transfer is too high. Moreover, in case that the voltage of transfer is too high, an electric shock to an image holding body 21 occurs. These problems are solved by setting a range to the voltage of transfer. That is, a lower limit of the voltage and an upper limit of the voltage are contained in the transfer limit memory section 9. Here, a lower limit of the voltage is a boundary to a region where lack of transfer occurs. And, an upper limit of the voltage is a boundary to a region where excess of transfer occurs.

Figure 4:
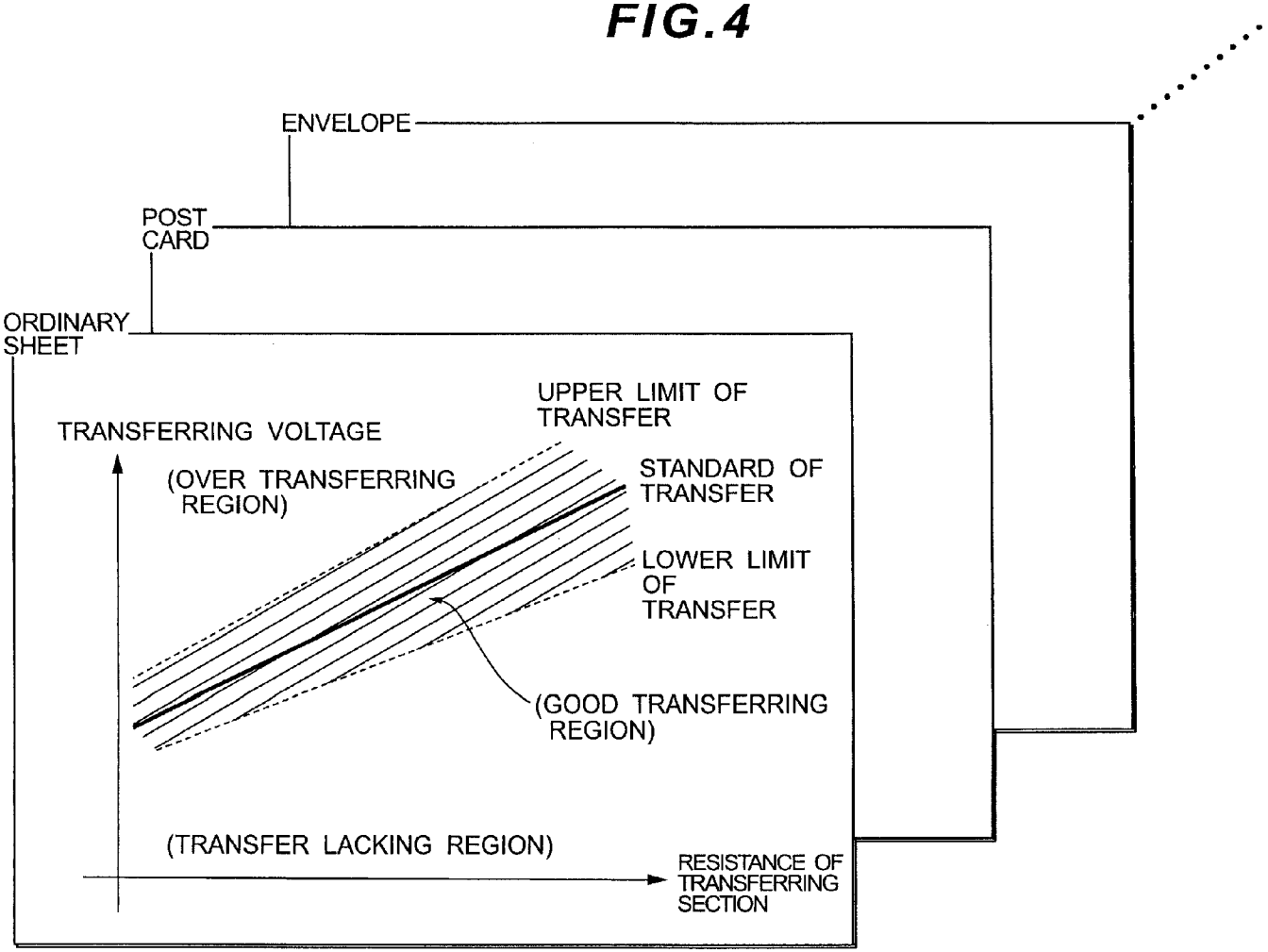
FIG. 4 shows a setting table of standard information of transfer with limits of Embodiment 1.

FIG. 4 shows a setting table of standard information of transfer with limits of Embodiment 1.

As shown in FIG. 4, lower limit of the voltage and upper limit of the voltage are contained, adding to the setting table of standard information of transfer corresponding to each kind of the recording media such as an ordinary sheet, a post card, an envelope etc. So, a range between the lower limit of the voltage and the upper limit of the voltage, is a range where transfer is good.

A correct transferring parameter memory section 10 is a memory section to memorize information of transfer for correction. Here, this information of transfer for correction is used for correcting the standard information of transfer according to a method of each user. This information of transfer for correction is selected from between the lower limit and the upper limit. That is, any user is not allowed to correct using a voltage selected from outside of the range between the lower limit and the upper limit.

A transferring section 11 is a section for transferring an image formed with a toner, from the image holding body 21 to a recording medium 22. This section comprises a transfer condition setting section 12, a transferring control section 13, a transferring unit 14 and a detecting section 15.

The transfer condition setting section 12 is a section for setting a condition of transfer according to standard information of transfer, and information of transfer for correction included in a printing job sent from the information processing apparatus 2. That is, this is a section for deciding a condition of transfer to a value between the lower limit and the upper limit by using the standard information of transfer and the information of transfer for correction.

The transferring control section 13 is a section for selecting a method of control of transfer. This transferring control section 13 comprises a constant voltage control section 16, a constant current control section 17, and a control changing section 18. The constant voltage control section 16 is a section for performing a control of transfer with a method of controlling constant voltage. The constant current control section 17 is a section for performing a control of transfer with a method of controlling constant current. And, the control changing section 18 is a section for changing a control of transfer between the constant voltage control section 16 and the constant current control section 17.

The detecting section 15 is a sensor for detecting a value of a voltage impressed to the transferring unit 14 and a value of a current flown to the transferring unit 14. The transferring unit 14 is a transferring roller 105 (FIG. 2) for transferring an image formed with a toner on an image holding body 21 to a recording medium 22, by impressing a strong electric field. The image holding body 21 is a section, that is, a photosensitive drum for forming an image with a toner on a latent image of static electricity on a surface of a drum based on a bit map data received from the information processing apparatus 2.

That is all of the description of the image forming apparatus 3. Subsequently, a description about the information processing apparatus 2 will be performed.

When a user inputs information of an image to request printing (forming an image), the information processing apparatus 2 generates a prescribed printing job and send it out to the image forming apparatus 3. Thus, the information processing apparatus 2 corresponds to an outer apparatus set forth in the claims. It comprises a communication section 4, driver 6 and an input section 7.

The communication section 4 is a section for operating as an interface which connects the information processing apparatus 2 with a serial interface or network not shown in the drawing, connected with the image forming apparatus 3. The driver 6 is a section for sending information of an image inputted by a user, to the communication section 4, after changing the information of an image to a printing job.

The input section 7 is a section for functioning as an interface between the information processing apparatus 2 and the user in order to input information of an image requested by the user. Especially in the present invention, the information processing apparatus 2 is a section for inputting information for selection, selecting specific standard information of transfer, among plural standard information of transfer, which are memorized in the standard transferring parameter memory section 8; and information of transfer for correction, for correcting the specific standard information of transfer according to a method of the user.

That is all of the description about the image forming system of the present invention. Subsequently, an operation of the image forming system of the present invention will be described.

<Operation>

Figure 5A:
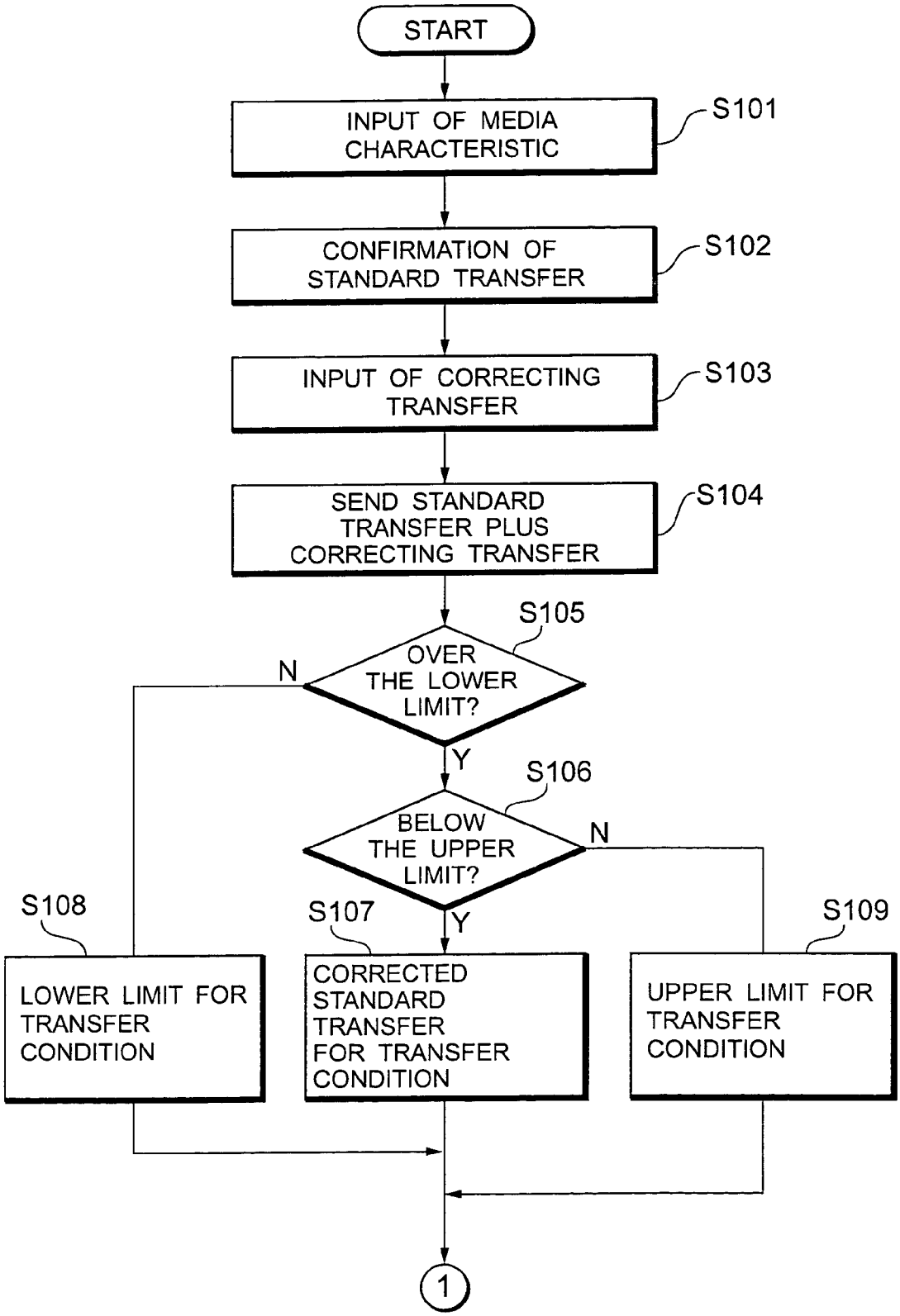
FIG. 5 is a flow chart showing an operation of Embodiment 1.
Figure 5B:
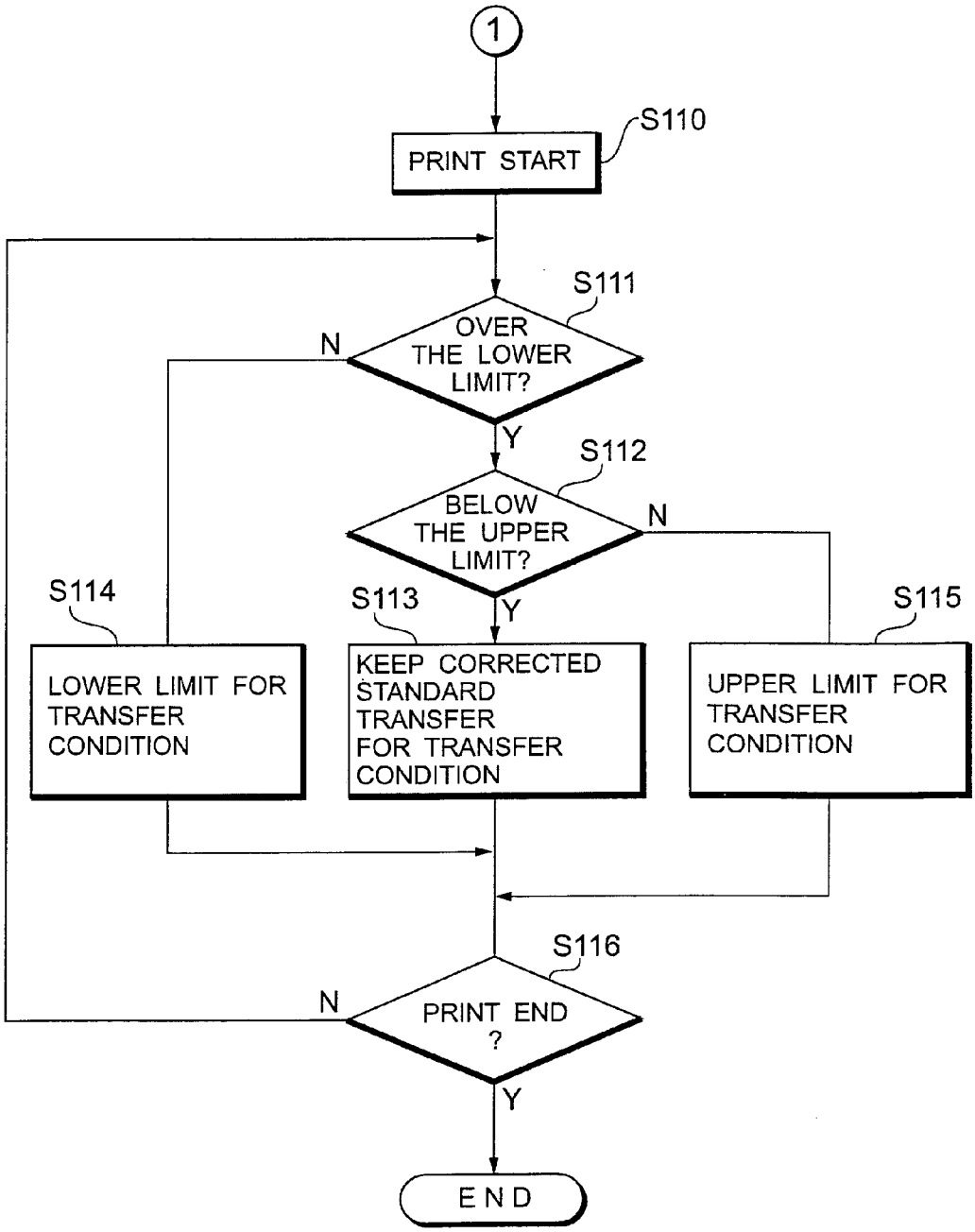

FIG. 5 is a flow chart showing an operation of Embodiment 1.

Figure 6:
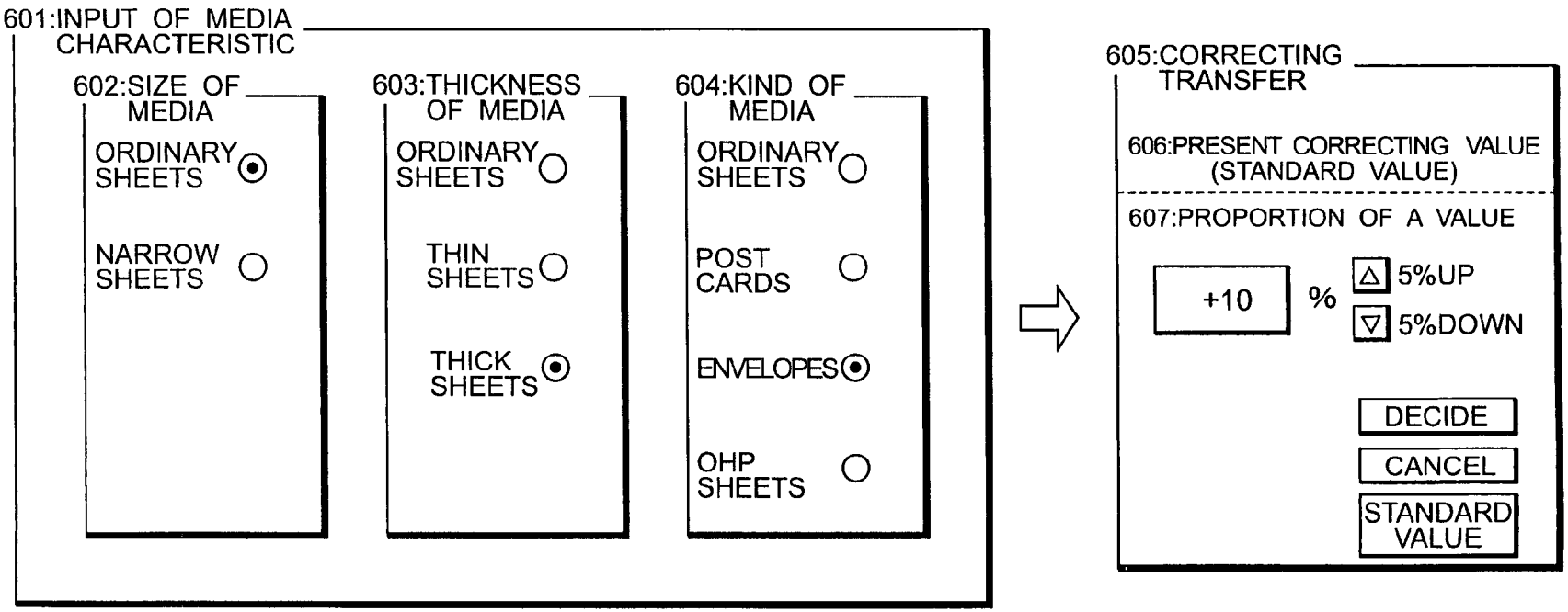
FIG. 6 shows a property of an input unit of Embodiment 1.

FIG. 6 shows a property of an input unit of Embodiment 1.

Figure 7:
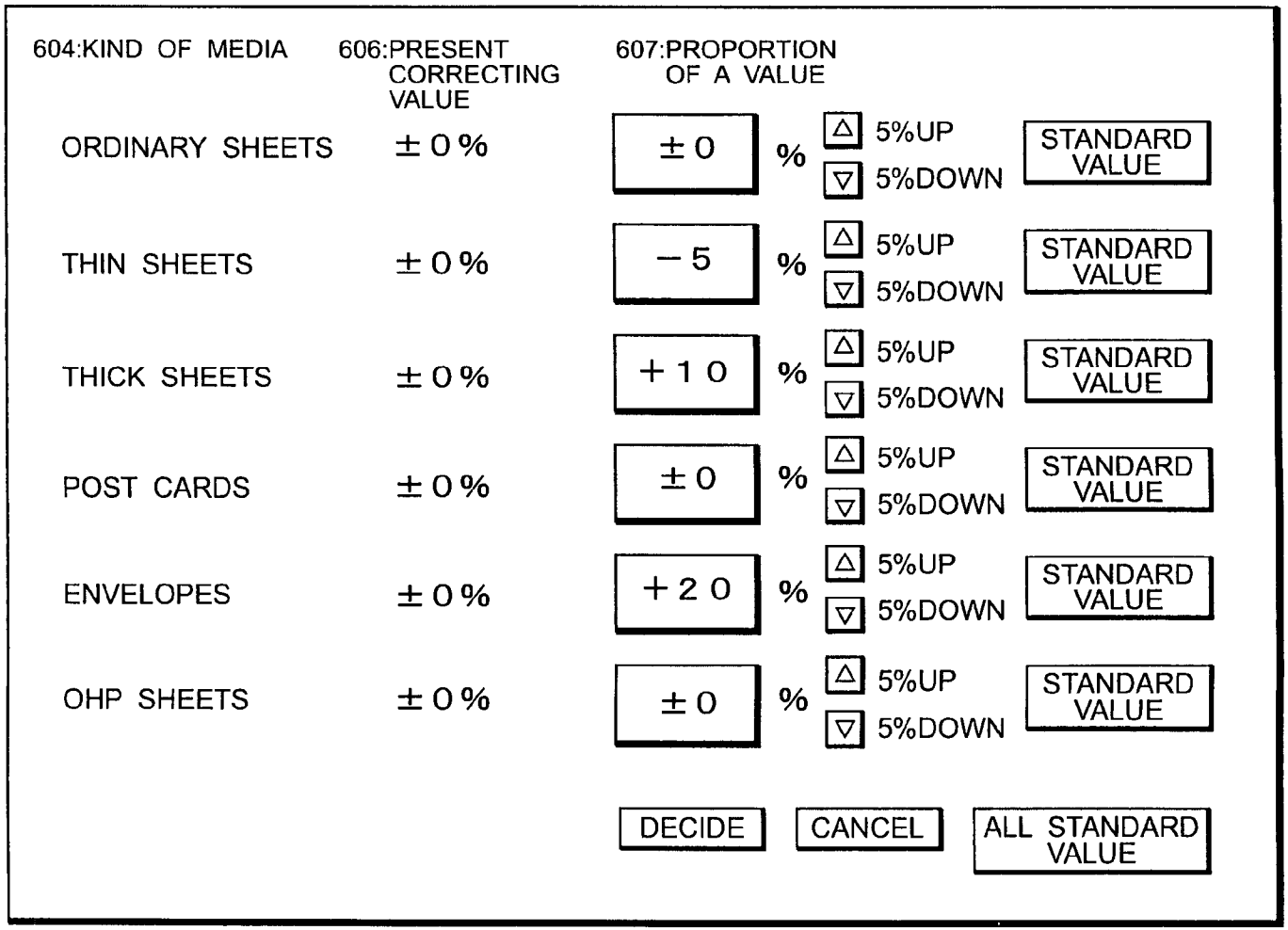
FIG. 7 shows another property of the input unit of Embodiment 1.

FIG. 7 shows another property of the input unit of Embodiment 1.

Referring to steps S101 to S116 of FIG. 5, an operation of the image forming system of Embodiment 1 will be described in order of these steps.

STEP S101

First of all, a user is requested to input a characteristic of the recording media, so as to decide a standard information of transfer for the recording media which need correction. At this time, a property for input of media characteristic 601 shown in FIG. 6 is presented at an presenting apparatus (not shown in the drawings) of an input section 7 (c.f. FIG. 1). By using this property, the user select a size of media 602 (ordinary sheets or narrow sheets), a thickness of media 603 (ordinary sheets, thin sheets or thick sheets), a kind of media 604 (ordinary sheets, post cards, envelopes or OHP sheets). That is, each selection is inputted.

STEP S102

After the standard information of transfer is decided, succeedingly, a property for input of correcting transfer 605 shown in FIG. 6 is presented at an presenting apparatus of an input section 7 not shown in FIG. 6. A present correcting value 606 corresponding to the standard information of transfer, is presented.

STEP S103

The user inputs a correcting value according to the above property. For example, proportion of a value 607 for correction of transfer based on the standard information of transfer, is inputted. A method of inputting, is to put a desired numerical value directly to an input area with a keyboard etc. or to adjust a presented numerical value to a desired value with operating a pair of up-down buttons to increase the value or to decrease the value.

STEP S104

A selection to select the standard information for the recording media, and the information of correction for the standard information mentioned above; are included in a printing job with data for printing. And, this printing job is sent from the information processing apparatus 2 to the image forming apparatus 3 through the communication section 4 and 5. In the image forming apparatus 3, a specific data of the standard information is selected by the selection included in the printing job, from plural data of the standard information contained in the standard transferring parameter memory section 8. Moreover, a data of the information of correction is memorized in the transfer correction memory section 10. The transfer condition setting section 12 adds the value for correction to the value of the standard information selected. At the same time, it reads out a limit value corresponding to the standard information selected, from the transfer limit memory section 9.

STEP 105

The transfer condition setting section 12 compares a value obtained by adding the correction value to the standard value, with a lower limit value of transfer. In case that the added value is larger than the lower limit value, the process proceeds to STEP S106. In case that the added value is smaller than the lower limit value, the process proceeds to STEP S108.

STEP S106

The transfer condition setting section 12 compares the added value mentioned above, with an upper limit value of transfer. In case that the added value is smaller than the upper limit value, the process proceeds to STEP S107. In case that the added value is larger than the upper limit value, the process proceeds to STEP S109.

STEP S107

The transfer condition setting section 12 sets a value for the condition of transfer, to the standard value plus the correction value.

STEP S108

The transfer condition setting section 12 sets a value for the condition of transfer, to the lower limit of transfer.

STEP S109

The transfer condition setting section 12 sets a value for the condition of transfer, to the upper limit of transfer.

STEP S110

The transferring control section 13 accept the value set by the transfer condition setting section 12. Then, a transferring unit 14 is impressed with a corresponding voltage for transfer, so as to start printing.

STEP S111

After starting of printing, a detecting section 15 starts measuring a voltage for transfer and a current for transfer. The transfer condition setting section 12 compares the measured value obtained by the detecting section 15, with a lower limit value of transfer. In case that the measured value is larger than the lower limit value, the process proceeds to STEP S112. In case that the measured value is smaller than the lower limit value, the process proceeds to STEP S114.

STEP S112

The transfer condition setting section 12 compares the measured value obtained by the detecting section 15, with an upper limit value of transfer. In case that the measured value is smaller than the upper limit value, the process proceeds to STEP S113. In case that the measured value is larger than the upper limit value, the process proceeds to STEP S115.

STEP S113

The transfer condition setting section 12 keeps a value for the condition of transfer, to the standard value plus the correction value.

STEP S114

The transfer condition setting section 12 changes to set a value for the condition of transfer, to the lower limit of transfer.

STEP S115

The transfer condition setting section 12 changes to set a value for the condition of transfer, to the upper limit of transfer.

STEP S116

The above STEP's S111 to S116 are repeated until printing for all the printing data is finished. When printing for all the printing data is finished, the process ends.

<Effects>

As described above, according to Embodiment 1, when the user inputted a value for correcting transfer based on the user's own method with using an input device provided at an information processing apparatus, the information processing apparatus sends the information for correcting transfer included in a printing job, to an image forming apparatus. The information for correcting transfer, is used only for the job that includes the information. Therefore, each user never worry that the transfer be changed by other users. Each user always gets the user's own transfer.

Moreover, a user never worry that each printing job be printed with a wrong transfer. Each printing job is always performed with a suitable transfer, because each printing job gets the job's own transfer. That is, when a change for transfer becomes needless, the user does not need to recover the former transfer, unlike the conventional printer or printing system.

Incidentally, in the above description, a property shown in FIG. 6 is described. However, the present invention is not limited to this example. That is, another property shown in FIG. 7 can be adopted. In this property, selection for the standard information and an inputting operation for correcting the standard information, can be performed at a same time. That is, STEP S102 and S103 of FIG. 5 are combined to perform a STEP.

Embodiment 2

<Configuration>

In Embodiment 1, a condition of transfer is set regardless of circumstance such as temperature or humidity. However, an adequate condition of transfer can change according to the circumstance. Therefore, in Embodiment 2, provided is an apparatus or system that can correct the condition of transfer according to a specific circumstance.

Hereafter, only different points from Embodiment 1 will be described.

Figure 8:
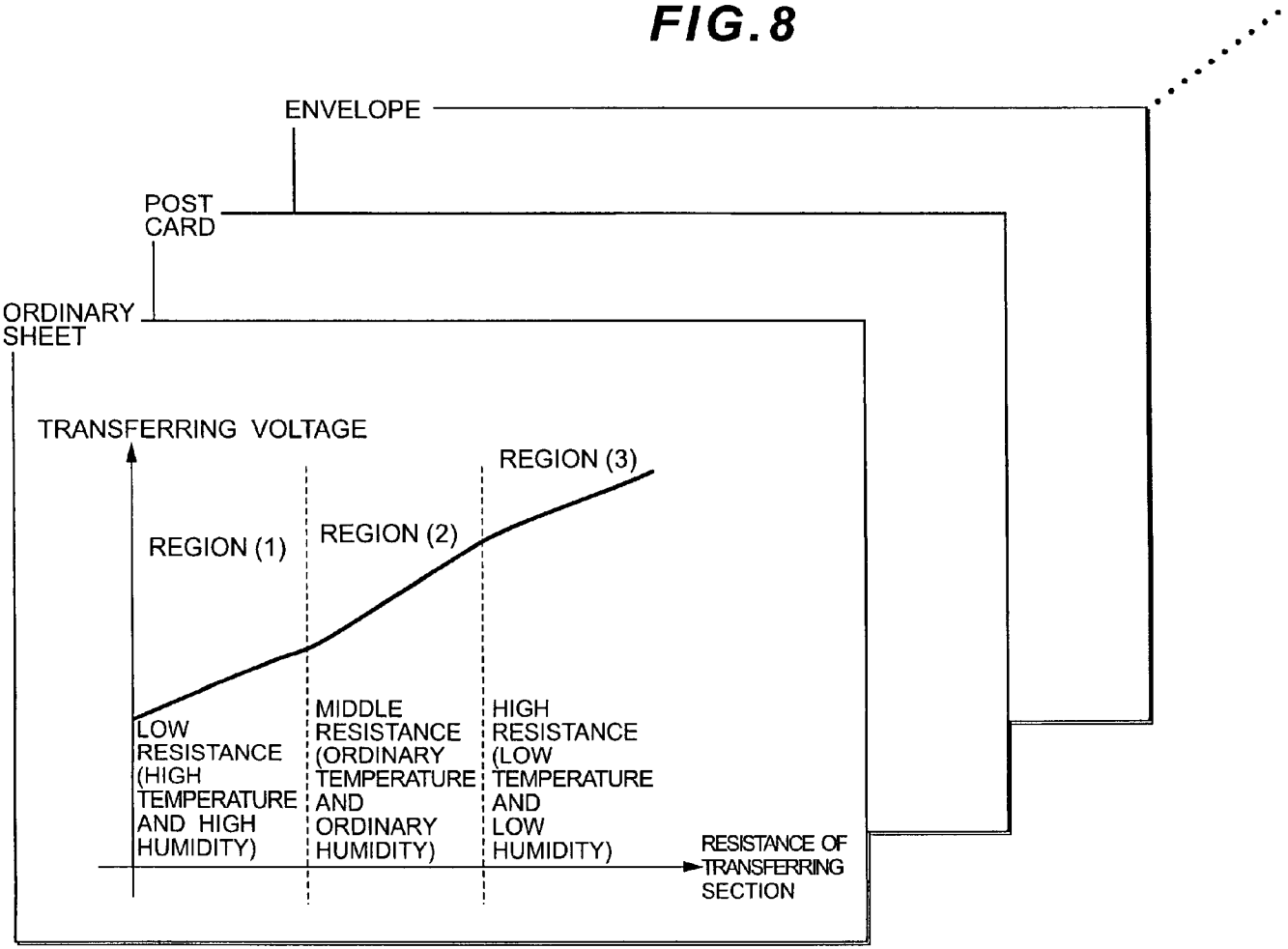
FIG. 8 shows a setting table of standard information of transfer of Embodiment 2.

FIG. 8 shows a setting table of standard information of transfer of Embodiment 2.

As shown in FIG. 8, a setting table of standard information of transfer are contained corresponding to each kind of the recording media such as an ordinary sheet, a post card, an envelope etc. An abscissa of each table represents a value of resistance of the transferring unit. An ordinate of each table represents a voltage of transfer corresponding to each value of resistance of the transferring unit. Further, the setting table is divided into three regions of a low resistance (high temperature and high humidity), a middle resistance (ordinary temperature and ordinary humidity) and a high resistance (low temperature and low humidity).

Figure 9:
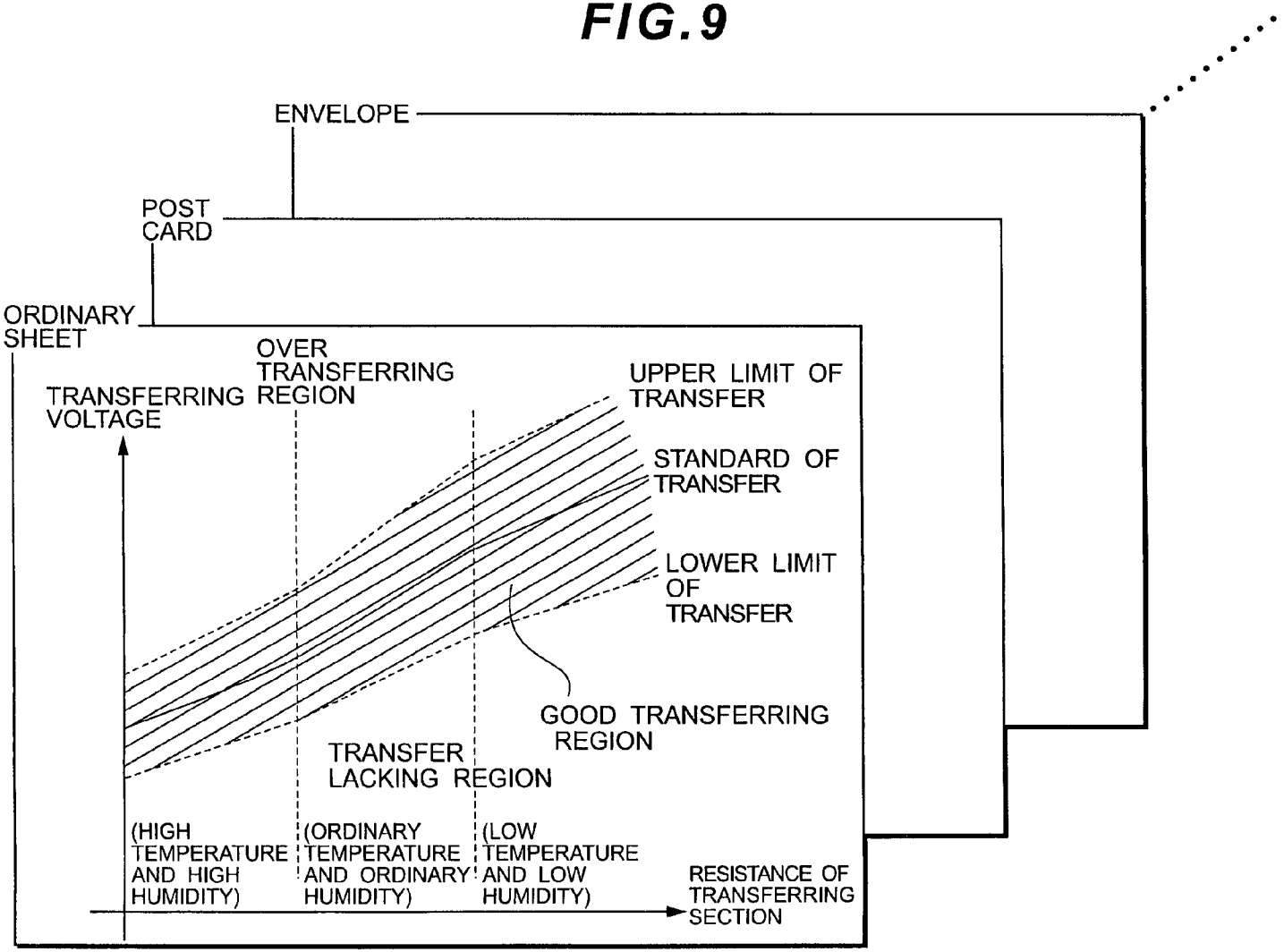
FIG. 9 shows a setting table of standard information of transfer with limits of Embodiment 2.

FIG. 9 shows a setting table of standard information of transfer with limits of Embodiment 2.

As shown in FIG. 9, lower limit of the voltage and upper limit of the voltage are contained, adding to the setting table of standard information of transfer corresponding to each kind of the recording media such as an ordinary sheet, a post card, an envelope etc. So, a range between the lower limit of the voltage and the upper limit of the voltage, is a range where transfer is good. Further, the setting table is divided into three regions of a low resistance (high temperature and high humidity), a middle resistance (ordinary temperature and ordinary humidity) and a high resistance (low temperature and low humidity).

Figure 10:
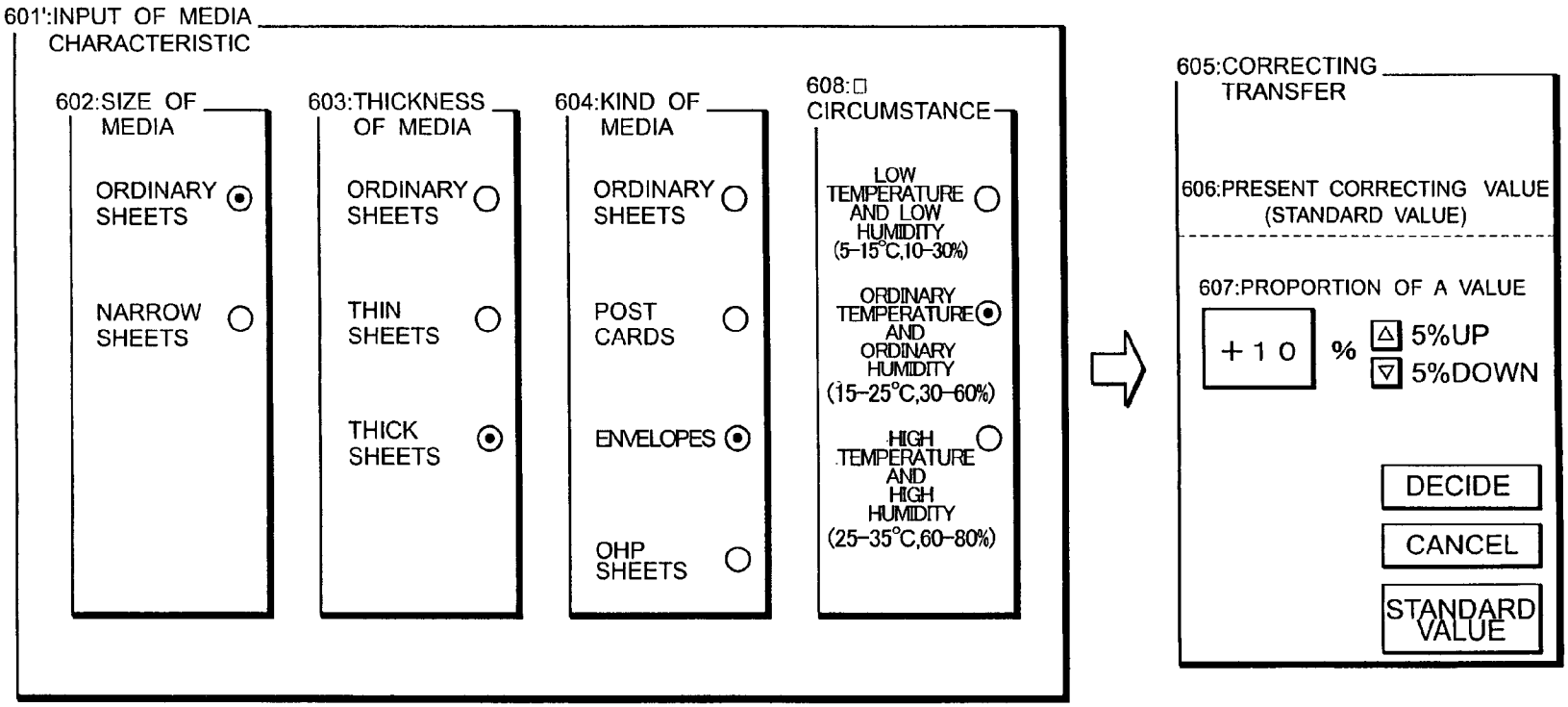
FIG. 10 shows a property of an input unit of Embodiment 2.

FIG. 10 shows a property of an input unit of Embodiment 2.

As shown in FIG. 10, a property of an inputting unit of Embodiment 2, is what is added to a property of an inputting unit of Embodiment 1 a selection of circumstance. In Embodiment 2, coping with a specific circumstance, the same effect as Embodiment 1 is obtained.

The other component parts are same as Embodiment 1. So, the description is omitted. Subsequently, an operation of Embodiment 2 will be described.

<Operation>

Figure 11A:
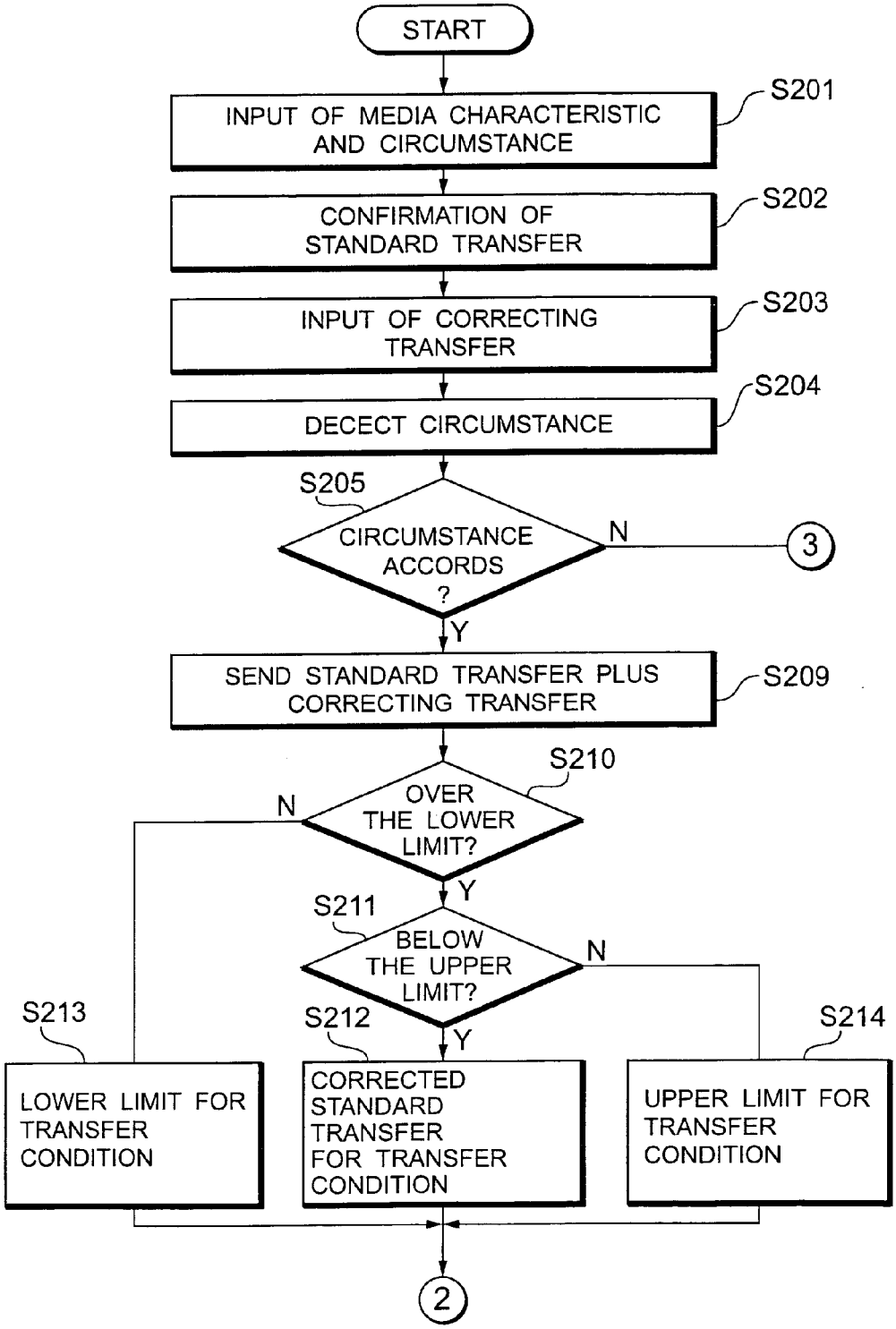
FIG. 11 is a flow chart showing an operation of Embodiment 2.
Figure 11B:
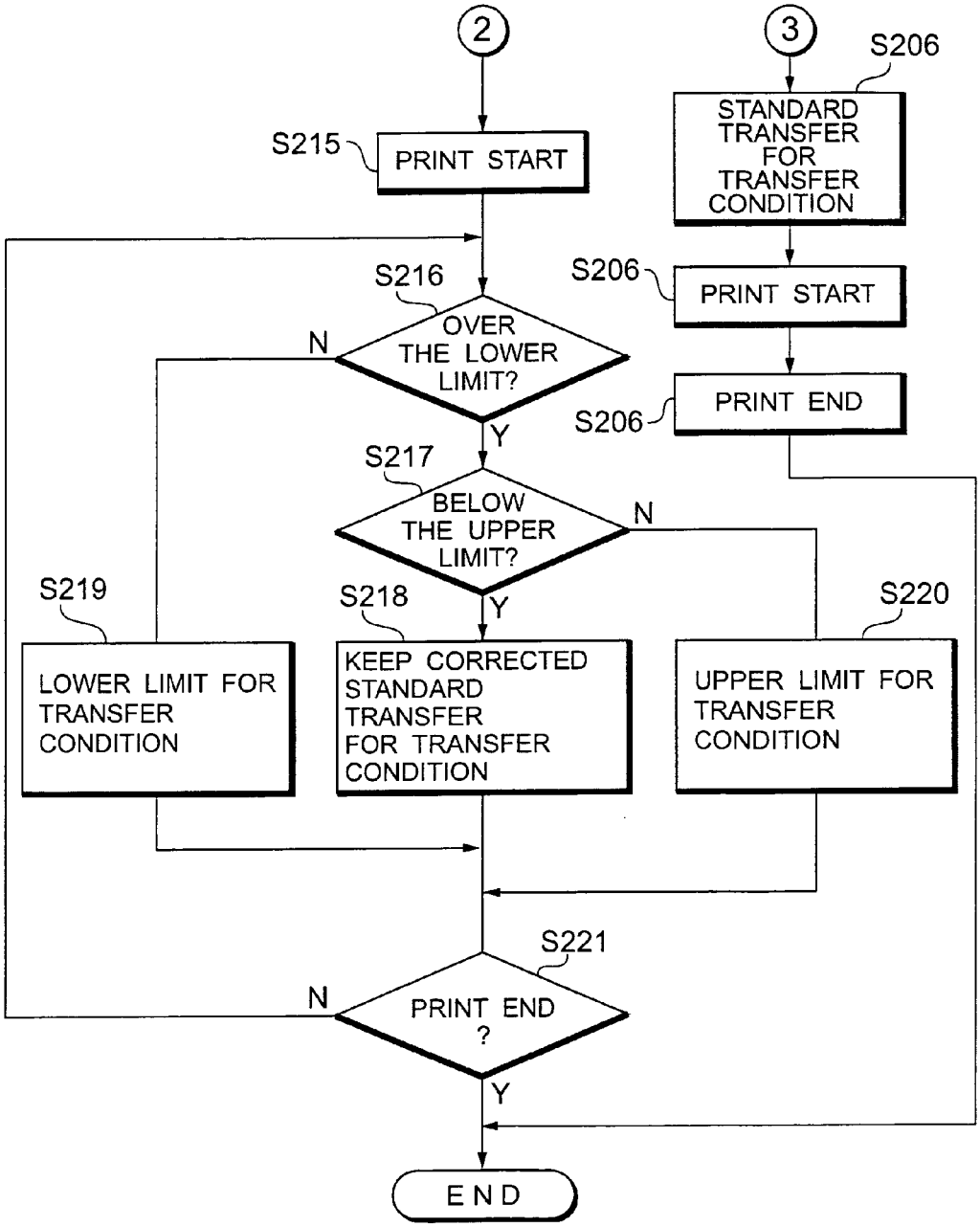

FIG. 11 is a flow chart showing an operation of Embodiment 2.

STEP S201

First of all, a user is requested to input a characteristic of the recording media, so as to decide a standard information of transfer for the recording media which need correction. At this time, a property for input of media characteristic 601 shown in FIG. 10 is presented at an presenting apparatus (not shown in the drawings) of an input section 7 (c.f. FIG. 1). By using this property, the user select a size of media 602 (ordinary sheets or narrow sheets), a thickness of media 603 (ordinary sheets, thin sheets or thick sheets), a kind of media 604 (ordinary sheets, post cards, envelopes or OHP sheets), and a circumstance 608 (low temperature and low humidity, ordinary temperature and ordinary humidity, and high temperature and high humidity). That is, each selection including circumstance is inputted.

STEP S202

After the standard information of transfer is decided, succeedingly, a property for input of correcting transfer 605 shown in FIG. 10 is presented at a presenting apparatus of an input section 7 not shown in FIG. 10. A present correcting value 606 corresponding to the standard information of transfer, is presented.

STEP S203

The user inputs a correcting value according to the above property. For example, proportion of a value 607 for correction of transfer based on the standard information of transfer, is inputted. A method of inputting, is to put a desired numerical value directly to an input area with a keyboard etc. or to adjust a presented numerical value to a desired value with operating a pair of up-down buttons to increase the value or to decrease the value.

STEP S204

A selection to select the standard information for the recording media, the information of circumstance and the information of correction for the standard information mentioned above; are included in a printing job with data for printing. And, this printing job is sent from the information processing apparatus 2 to the image forming apparatus 3 through the communication section 4 and 5. In the image forming apparatus 3, a thermal sensor and a humid sensor for circumstance not shown in the drawings are provided, so as to send results of detection to the transfer condition setting section 12. The transfer condition setting section 12 judges from the results of detection, which region the present circumstance belongs to, among "low temperature and low humidity", "ordinary temperature and ordinary humidity", and "high temperature and high humidity".

A selection to select the standard information for the recording media, the information of circumstance and the information of correction for the standard information mentioned above; included in a printing job with data for printing; are sent to the image forming apparatus 3. In the image forming apparatus 3, a specific data of the standard information is selected by the selection included in the printing job, from plural data of the standard information contained in the standard transferring parameter memory section 8. Moreover, a data of the information of correction is memorized in the transfer correction memory section 10.

STEP S205

The transfer condition setting section 12 judges whether the information of circumstance inputted at STEP S201 accords with the information of circumstance detected at STEP S204. In case that the information of circumstance does not accord, the process proceeds to STEP S206. In case that the information of circumstance accords, the process proceeds to STEP S209.

STEP S206

The transfer condition setting section 12 does not perform, because it cannot get information for correcting transfer. Therefore, the transfer condition setting section 12 sets the condition of transfer, to standard information of transfer.

STEP S207

The transferring control section 13 accept the value set by the transfer condition setting section 12. Then, a transferring unit 14 is impressed with a corresponding voltage for transfer, so as to start printing.

STEP S208

When printing for all the printing data is finished, the process ends.

STEP S209

The transfer condition setting section 12 adds the value for correction to the value of the standard information selected. At the same time, it reads out a limit value corresponding to the standard information selected, from the transfer limit memory section 9.

STEP S210

The transfer condition setting section 12 compares a value obtained by adding the correction value to the standard value, with a lower limit value of transfer. In case that the added value is larger than the lower limit value, the process proceeds to STEP S211. In case that the added value is smaller than the lower limit value, the process proceeds to STEP S213.

STEP S211

The transfer condition setting section 12 compares the added value mentioned above, with an upper limit value of transfer. In case that the added value is smaller than the upper limit value, the process proceeds to STEP S212. In case that the added value is larger than the upper limit value, the process proceeds to STEP S214.

STEP S212

The transfer condition setting section 12 sets a value for the condition of transfer, to the standard value plus the correction value.

STEP S213

The transfer condition setting section 12 sets a value for the condition of transfer, to the lower limit of transfer.

STEP S214

The transfer condition setting section 12 sets a value for the condition of transfer, to the upper limit of transfer.

STEP S215

The transferring control section 13 accept the value set by the transfer condition setting section 12. Then, a transferring unit 14 is impressed with a corresponding voltage for transfer, so as to start printing.

STEP S216

After starting of printing, a detecting section 15 starts measuring a voltage for transfer and a current for transfer. The transfer condition setting section 12 compares the measured value obtained by the detecting section 15, with a lower limit value of transfer. In case that the measured value is larger than the lower limit value, the process proceeds to STEP S217. In case that the measured value is smaller than the lower limit value, the process proceeds to STEP S219.

STEP S217

The transfer condition setting section 12 compares the measured value obtained by the detecting section 15, with an upper limit value of transfer. In case that the measured value is smaller than the upper limit value, the process proceeds to STEP S218. In case that the measured value is larger than the upper limit value, the process proceeds to STEP S220.

STEP S218

The transfer condition setting section 12 keeps a value for the condition of transfer, to the standard value plus the correction value.

STEP S219

The transfer condition setting section 12 changes to set a value for the condition of transfer, to the lower limit of transfer.

STEP S220

The transfer condition setting section 12 changes to set a value for the condition of transfer, to the upper limit of transfer.

STEP S221

The above STEP's S216 to S221 are repeated until printing for all the printing data is finished. When printing for all the printing data is finished, the process ends.

<Effects>

As described above, according to Embodiment 2, when the user inputted a value for correcting transfer based on the user's own method and circumstance with using an input device provided at an information processing apparatus, the information processing apparatus sends the information for correcting transfer and circumstance included in a printing job, to an image forming apparatus. The information for correcting transfer and circumstance, is used only for the job that includes the information. Therefore, each user never worry that the transfer be changed by other users. Each user always gets the user's own transfer. Moreover, correction of transfer is performed under the consideration of circumstance.

Incidentally, detection of circumstance is performed by sensors not shown in the drawings provided in the image forming apparatus. However, the present invention is not limited to this example. That is, circumstance can be detected from a value of resistance of the transferring unit 14. Here, the resistance is calculated from a current and a voltage of the transferring unit 14. So, a voltage generated at the transferring unit 14; when a prescribed current detected beforehand, flows in the transferring unit 14; is detected by the voltage detecting section 19.

In the description mentioned above, only an electrophotographic printer is described as an example of an image forming apparatus of the present invention. However, the present invention is not limited to this example. That is, the present invention is able to be applied to a copy machine or facsimile which gives the same effects mentioned above.

What is claimed is:

1. An image forming apparatus comprising:

a transferring unit for transferring an image formed by toner onto various record mediums;

a setting section for setting a transfer condition to correspond to the one of the various record mediums in order to control said transferring unit;

a memorizing section for memorizing a plurality of standard transfer conditions that respectively correspond to the various record mediums and are previously decided, a transfer limit memory for memorizing respective upper limits and lower limits of the different standard conditions, the upper and lower limits representing correction information; and wherein the setting section calculates an initial condition on the basis of said correction information and said one of said different standard conditions; performs comparison operations between the initial condition and the upper limit and between the initial condition and the lower limit; if the initial condition is less than the upper limit and is more than the lower limit, sets the initial condition as the transfer condition; if the initial condition exceeds the upper limit, sets the upper limit as the transfer condition; if the initial condition is below the lower limit, sets the lower limit as the transfer condition;

wherein said transferring unit performs a transfer according to said transfer condition set by said setting section.

2. The image forming apparatus according to the claim 1 further comprising:

a transfer correction memory section for memorizing the correction information.

3. The image forming apparatus according to claim 1:

wherein a printing job includes a correction to correct said specific piece of standard information for transfer selected, corresponding to a specific circumstance.

4. An image forming system, which includes the image forming apparatus according to claim 1, wherein the image forming apparatus connected to the image forming system receives a printing job from other apparatus connected to the image forming system with an instruction of changing a condition of transfer that corresponds to said job and that is valid only for said job.

5. An image forming apparatus, comprising:

a transferring unit for transferring an image onto a record medium;

a memorizing section for memorizing a standard condition used for controlling said transferring unit and upper and lower limits of the standard condition;

a receiving section for receiving a correction information that represents a deviation from the standard condition and is used to correct said standard condition;

a setting section which sets a transfer condition by correcting said standard condition on the basis of said correction information, wherein the setting section calculates an initial condition on the basis of said correction information and said standard condition; performs comparison operations between the initial condition and the upper limit and between the initial condition and the lower limit; if the initial condition is less than the upper limit and is more than the lower limit, sets the initial condition as the transfer condition; if the initial condition exceeds the upper limit, sets the upper limit as the transfer condition; if the initial condition is below the lower limit, sets the lower limit as the transfer condition, wherein said transferring unit performs a transfer according to said transfer condition set by said setting section.

6. The image forming apparatus according to claim 5, wherein said standard condition is one of a plurality of standard conditions, the plurality of standard conditions corresponding to different record mediums.

7. The image forming apparatus according to claim 6, wherein each said different record medium has a particular thickness.

8. The image forming apparatus according to claim 5, wherein said receiving section further receives a selection information to correspond to said record medium, said standard condition is selected from a plurality of standard conditions according to said selection information, the plurality of standard conditions correspond to different record mediums.

9. The image forming apparatus according to claim 8, wherein each said different record medium has a particular thickness.

* * * * *